US007047858B2

(12) United States Patent
Rohrer et al.

(10) Patent No.: US 7,047,858 B2
(45) Date of Patent: May 23, 2006

(54) CHAMFER DEVICE FOR CUTTING PACKAGING MATERIALS

(75) Inventors: Hans-Peter Rohrer, Möhlin (CH); Heinz Zumsteg, Zeiningen (CH); Alfred Raggenbass, Dielsdorf (CH)

(73) Assignee: Rohrer AG, Mohlin (CH)

( * ) Notice: Subject to any disclaimer, the term of this patent is extended or adjusted under 35 U.S.C. 154(b) by 443 days.

(21) Appl. No.: 10/148,470

(22) PCT Filed: Dec. 6, 2000

(86) PCT No.: PCT/CH00/00646

§ 371 (c)(1),
(2), (4) Date: May 31, 2002

(87) PCT Pub. No.: WO01/41984

PCT Pub. Date: Jun. 14, 2001

(65) Prior Publication Data

US 2002/0178885 A1 Dec. 5, 2002

(30) Foreign Application Priority Data

Dec. 10, 1999 (CH) ..... 2280/99

(51) Int. Cl.
*B26D 5/08* (2006.01)

(52) U.S. Cl. ..... 83/582; 83/639.1; 83/667; 83/681; 83/682

(58) Field of Classification Search ..... 83/639.1, 83/667, 682, 681, 879–883, 582, 652–657
See application file for complete search history.

(56) References Cited

U.S. PATENT DOCUMENTS

| | | | | |
|---|---|---|---|---|
| 2,663,180 | A | 12/1953 | Benedict | |
| 4,250,784 | A * | 2/1981 | Bredow | 83/549 |
| 4,273,738 | A | 6/1981 | Spengler | |
| 4,329,897 | A * | 5/1982 | Scribner | 83/225 |
| 4,631,996 | A * | 12/1986 | Magnuson | 83/639.1 |

(Continued)

FOREIGN PATENT DOCUMENTS

| | | |
|---|---|---|
| CH | 447 461 | 11/1967 |

(Continued)

*Primary Examiner*—Allan N. Shoap
*Assistant Examiner*—Jason Prone
(74) *Attorney, Agent, or Firm*—Leydig, Voit & Mayer, Ltd.

(57) ABSTRACT

A chamfer cutting device for cuffing packaging materials comprises a die and a knife part which has a plurality of knives. The die can be moved toward the knife part in order to carry out a cut. The knives are arranged individually in the knife part in a force-dependent manner in such a way that their position with respect to the tool plate varies in a defined way as a function of the force produced by contact with the packaging material or the die. In the event of contact between the knife and the die, a force acts on the knife which does not exceed a predefined maximum force. The chamfer cutting device has the advantage that the die can be guided right up to the knives.

16 Claims, 6 Drawing Sheets

U.S. PATENT DOCUMENTS

| | | | | | |
|---|---|---|---|---|---|
| 4,730,761 | A | * | 3/1988 | Spano | 83/375 |
| 4,833,884 | A | * | 5/1989 | Seko et al. | 83/693.5 |
| 4,905,558 | A | | 3/1990 | Corcoran | |
| 4,938,105 | A | * | 7/1990 | Böswarth | 83/652 |
| 4,951,537 | A | * | 8/1990 | Bennett | 83/76.6 |
| 4,993,295 | A | * | 2/1991 | Dacey, Jr. | 83/698.91 |
| 5,671,589 | A | | 9/1997 | Irvine et al. | |
| 5,797,189 | A | * | 8/1998 | Gilbert | 83/618 |
| 5,964,134 | A | * | 10/1999 | Arends | 83/681 |
| 6,000,311 | A | * | 12/1999 | Katoh et al. | 83/639.4 |
| 6,106,453 | A | * | 8/2000 | Sinn et al. | 83/55 |
| 6,314,852 | B1 | * | 11/2001 | Long et al. | 83/529 |
| 2004/0173072 | A1 | * | 9/2004 | Ishii et al. | 83/100 |

FOREIGN PATENT DOCUMENTS

| | | |
|---|---|---|
| DE | 43 11 092 | 12/1994 |
| DE | 195 21 604 | 4/1997 |
| EP | 615 910 | 9/1994 |
| EP | 655 303 | 5/1995 |

* cited by examiner

CHAMFER DEVICE FOR CUTTING PACKAGING MATERIALS

The present invention relates to a chamfer cutting device for cutting packaging materials.

Packages, such as yogurt pots, are often produced nowadays by being shaped and separated from a stream of thin sheet. The thin sheets used in this case are generally plastic films or metal foils, for example made of polystyrene, polyethylene, polypropylene or aluminum, and in particular composites thereof.

In order to separate packages, chamfer cutting devices may be used, which have a die and a knife part having a large number of knives and punches. The packaging material stream, in which the individual packages are normally already shaped, is introduced between the die and the knife part. The die and the knife part are then moved toward each other, as a result of which the packaging material is clamped, punched by the punches and cut by the knives. Finally, the die and knife part are moved apart again, it being ensured that the packaging material separates from the knife part and the die in order that the packaging material stream can be advanced further. The separation of the packaging material is achieved, for example, by means of sprung strippers on the side of the knife part and, on the side of the die, by pulling the latter away.

The packaging material can either be cut through completely by the knives or it can also be only chamfered, that is to say a cut can be started, the latter leading to the formation of intended dividing points, such as are known, for example, from coherent yogurt pots. Whether a knife cuts completely through the packaging material when carrying out a cut or only begins to cut it, depends on how close the die and the knife are guided toward each other, complete severing of the packaging material occurring depending on the packaging material at different minimum distances between die and knife.

Since it is very difficult to guide the die and the knives exactly toward each other when carrying out a cut, and since in addition differences can occur between the individual knives with respect to the minimum distance between knife and die which, for example, are based on different wear, on production tolerances or on different deformations in the chamfer cutting device, it is never possible for all the knives and the die to be guided completely against one another, so that in the case of most knives, there is no contact with the die. As a rule, with regard to minimizing the wear, a distance between the knives and the die is even deliberately left, this distance being different from knife to knife as a result of the aforementioned influences. However, this has the disadvantage that, in particular, tough packaging materials, such as polypropylene, are often not cut through cleanly. In addition, any differences between the individual knives with respect to the minimum distance between knife and die can lead to different cut results.

In view of the disadvantages of the previously known chamfer cutting devices described above, the invention is based on the following object. To be provided is a chamfer cutting device of the type mentioned at the beginning which, with the lowest possible wear on the knives, permits a clean execution of a cut with high process reliability, in particular even in the case of tough packaging materials.

This object is achieved by the chamfer cutting device according to the invention.

The nub of the invention is that, in a chamfer cutting device for cutting packaging materials, having a die and a knife part which has at least two knives, it being possible for the die and the knife part to be moved relative to each other in order to carry out a cut, at least one of the knives is arranged in the knife part in a force-dependent manner in such a way that its position with respect to a tool plate varies in a defined way as a function of the force produced by contact with a packaging material or the die, in the event of contact between the knife and the die a force acting on the knife which does not exceed a predefined maximum force.

The fact that at least one of the knives in the knife part is arranged in a force-dependent manner means that differences between individual knives with respect to the minimum distance between knife and die can be compensated for when carrying out a cut. Since the knife arranged in a force-dependent manner can change its position as a function of the force exerted by the packaging material or by the die on the knife, that is to say can retreat, for example, and since, even in the case of contact between knife and die, a predefined maximum force is not exceeded, unnecessarily high forces on the knife and therefore unnecessary material stresses and unnecessary wear, in particular material fatigue and deformation of the knife edge, can be avoided or minimized. In addition, it is not necessary to replace a knife that is worn more severely than the others immediately, since the wear-induced shortening of individual knives is compensated for by lesser retreat of these knives.

The chamfer cutting device is advantageously designed and controlled in such a way that the at least one knife arranged in a force-dependent manner comes into contact with the die when a cut is being carried out by moving the knife part and the die toward each other. Guiding the knife and the die completely together results in clean severing even of tough packaging materials.

Each of the knives in the knife part coming into contact with the die when a cut is being carried out is advantageously arranged in a force-dependent manner, individually or together with other knives in groups, such that its position with respect to a tool plate varies in a defined way as a function of the force produced by contact with a packaging material or the die, in the event of contact between the knife and the die a force acting on the knife which does not exceed a predefined maximum force. The die can then be guided completely up to all these knives or all these knives can be guided completely up to the die.

The predefined maximum force is advantageously adjustable. This adjustment can be used, for example, in order to adapt to a specific packaging material.

It has been shown that the chamfer cutting device is advantageously designed and controlled in such a way that when a cut is being carried out by moving the knife part and the die toward each other, a force of at most 1000 N per mm knife length, preferably 10–100 N per mm knife length and per mm thickness of the packaging material to be cut, acts on the knives. Under these forces, the knives do not become worn unnecessarily quickly. In order to carry out a good cut, on the other hand, a dividing force of at least 10 N per mm knife length and per mm material thickness is generally needed, depending on the packaging material.

The arrangements of the individual knives in the knife part can advantageously be changed over between a cutting position and a chamfering position, in the cutting position, when carrying out a cut, a knife cutting completely through the packaging material arranged between the knife and the die, while in the chamfering position, a knife only beginning to cut the packaging material arranged between the knife and the die. This permits the cutting configuration to be changed in a straightforward manner.

In a preferred design variant, a knife is arranged to receive a variable force; the knife is mounted on the tool plate via a gas piston, there preferably being means for feeding gas into and removing gas from a gas chamber of the gas piston, which makes it possible to adjust the dependence of the position of the knife with respect to the tool plate based on a variable force which acts on the knife. This adjustment can be used, for example, to adapt to a specific packaging material.

In an alternative, advantageous design variant, a liquid medium is used instead of a gas.

In yet another preferred design variant, to arrange a knife in a force-dependent manner, the latter is mounted on a tool plate by means of at least one resilient part, preferably one or more compression springs or a rubber cushion. There is preferably at least one direct or indirect stop for the knife, which limits the compression of the resilient part by the knife, in that, for example in the event of a high level of retreat of the knife, it absorbs the forces acting together with the knife. As a result, the resilient part is protected against inadmissibly high deformations or stresses.

In an advantageous design variant, at least one of the knives in the knife part is arranged to retreat in a force-dependent manner in such a way that under a loading which is less than a limiting force, it maintains its position, and under a loading which is greater than this limiting force, it retreats. As soon as the die exerts a force on the knife which is higher than the limiting force, the knife retreats. In this way, unnecessary wear or damage to the knife can be avoided, for example in the event of a foreign body present at the cutting location on the packaging material.

There is advantageously a stop for each knife in the knife part, on which the knife is supported directly or indirectly in the chamfering position when carrying out a cut. The stop is preferably adjustable, so that the cut depth can be varied. In the case of simple part cutting or chamfering, the die and the knife are not brought into contact, so that force-dependent arrangement of the knife does not normally provide any advantage.

There is preferably a stop, preferably an adjustable stop, for each knife in the knife part, on which the knife is supported directly or indirectly when carrying out part of a cut, in which a comparatively greater cutting force is required, while during the remainder of the cut, in which a comparatively smaller cutting force is required, it is spaced apart from the stop. As soon as the force acting on the knife reaches a specific value, the knife is supported directly or indirectly on the stop. If the force acting on the knife falls below this specific value again, for example at the end of the cutting operation, the knife is moved into a position closer to the die as a result of the force-dependent arrangement, or it is moved completely against the die and the packaging material is severed completely. One advantage of this stop is that the force that acts to the maximum extent in the event of contact between the knife and the die can be predefined smaller than the force needed to cut the packaging material.

In the following text, the chamfer cutting device according to the invention will be described in more detail using four exemplary embodiments and with reference to the appended drawings, in which.

FIRST EXEMPLARY EMBODIMENT—FIGS. 1 TO 5

Figure 1:
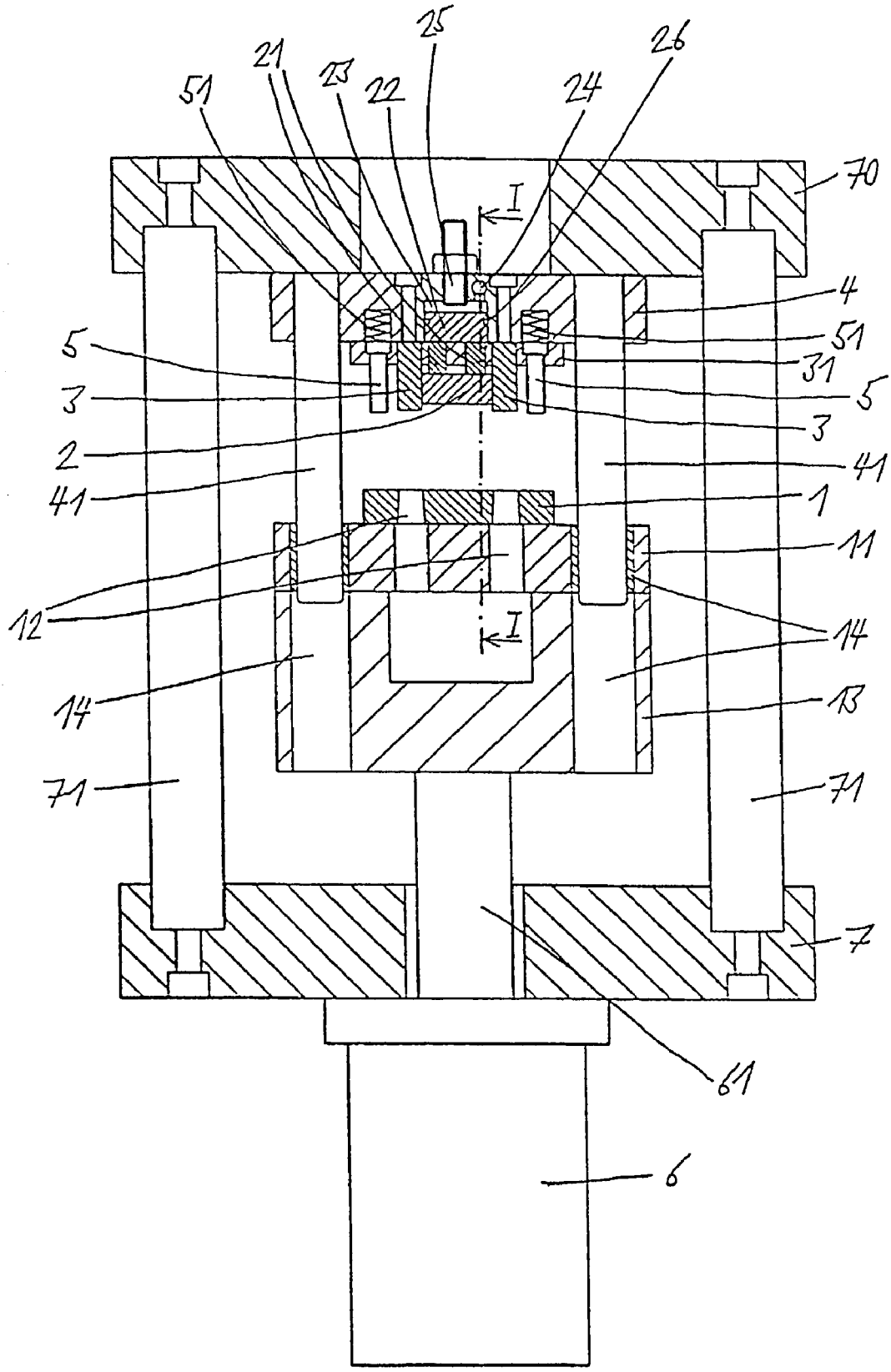
FIG. 1 shows a sectional view of a first exemplary embodiment of the chamfer cutting device according to the invention, having knives, arranged in a force-dependent maimer by means of gas pistons, and stops for the chamfering position.
Figure 2:
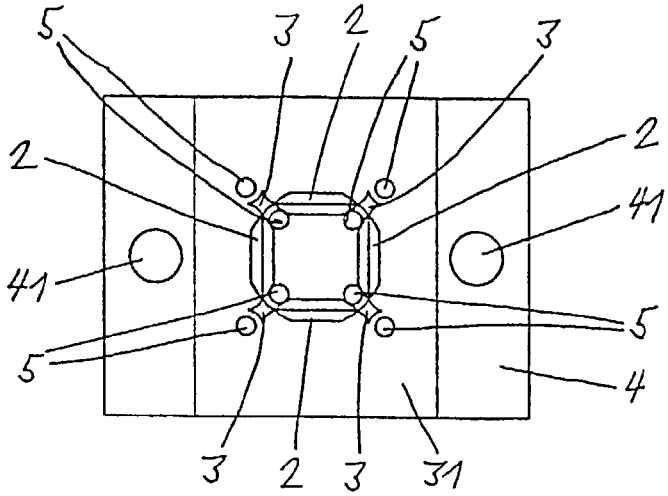
FIG. 2 shows a view from below of the knife part of the chamfer cutting device of FIG. 1.
Figure 3:
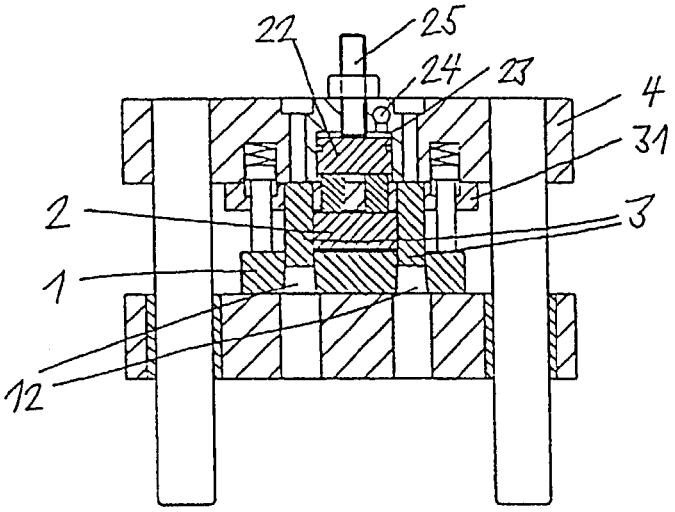
FIG. 3 shows a detail of the chamfer cutting device of FIG. 1 in the cutting and punching position.

The first exemplary embodiment illustrated of a chamfer cutting device according to the invention comprises, as a framework, a table plate 7 and a top plate 70, which are connected to each other by a total of four connecting columns 71, of which two are visible in FIG. 1. Fixed to the top plate 70 is a tool plate 4, to which in turn a punch holding plate 31 is fitted. Arranged on the tool plate 4 and the punch holding plate 31 are a total of four knives 2 which together approximately form a square, four stops 25, four punches 3, eight strippers 5 and two guide columns 41. The elements arranged directly and indirectly on the tool plate 4 will also be referred to together as the knife part within the context of the present description.

The two guide columns 41 each project into a guide column channel 14, which is formed in a die base 13 and a die plate 11 fitted thereto. The die plate 11 bears a die 1 and, together with the latter, has four punch channels 12, into which the four punches 3 penetrate when carrying out a cut. For this purpose, the die base 13, the die plate 11 and the die 1 are moved vertically upwards by means of a piston 61 of a hydraulic drive with a hydraulic cylinder 6, so that the packaging material 9 is clamped in between the die 1 and the knife part and is cut.

The knives 2 are in each case connected via two knife holders 21 to a piston 22, which is respectively mounted such that it can be displaced vertically in a gas chamber 23 formed in the tool plate 4. On the side of the piston facing away from the punch holding plate 31, the gas chamber 23 is filled with a gas, for example $N_2$ or compressed air, which is under a pressure of up to 300 bar. An annular seal 26 prevents gas from escaping from the gas chamber 23 between the chamber wall and the piston 22. The gas present in the gas chamber 23 forms a compressible mass which is compressed in the event of a sufficiently high pressure on the knife 2 and therefore via the knife holder 21 on the piston 22, so that the piston 22 and the knife 2 can retreat upward. Gas can be removed from the gas chamber 23 or supplied to it via a gas duct 24, by which means the pressure or a limiting force can be set. If a force lower than the limiting force acts on the knife 2, then the latter maintains its position relative to the tool plate 4, and if a force higher than the limiting force acts, then the knife retreats. The pressure is preferably set in such a way that a force of typically 10–100 N per mm knife length and per mm thickness of the packaging material, but at most 1000 N per mm knife length, acts on the knife 2 during cutting.

The stop 25 serves as an indirect support for the knife 2 in the so-called chamfering position. This is because if the packaging material 9 is not severed completely, but is only initially cut or chamfered, the knife 2 has to give way even under an extremely small pressure when a cut is being carried out, which can be achieved by reducing the gas pressure in the gas chamber 23 by removing gas via the gas duct 24. When a cut is being carried out, the knife 2 retreats upward until the piston 22 rests on the stop 25. By means of vertical displacement of the stop 25, here by screwing the latter in or out, the chamfer cutting depth in the packaging material 9 can be set.

The punches 3 are firmly screwed to the tool plate 4 and are held by the punch holding plate 31. When a cut is being carried out, they stamp star-shaped holes into the packaging material 9 and penetrate into the punch channels 12 in the die 1.

In order that the packaging material 9 is separated from the knife part after a cut has been carried out, the strippers 5 in the tool plate 4 are mounted via compression springs 51. The strippers 5 are initially pressed into the tool plate 4 by the die 1 when a cut is being carried out, the compression springs 51 being compressed. If the die 1 is then drawn away downward again, the compression springs 51 expand and eject the strippers 5 and the latter eject the packaging material 9 downward.

Figure 5:
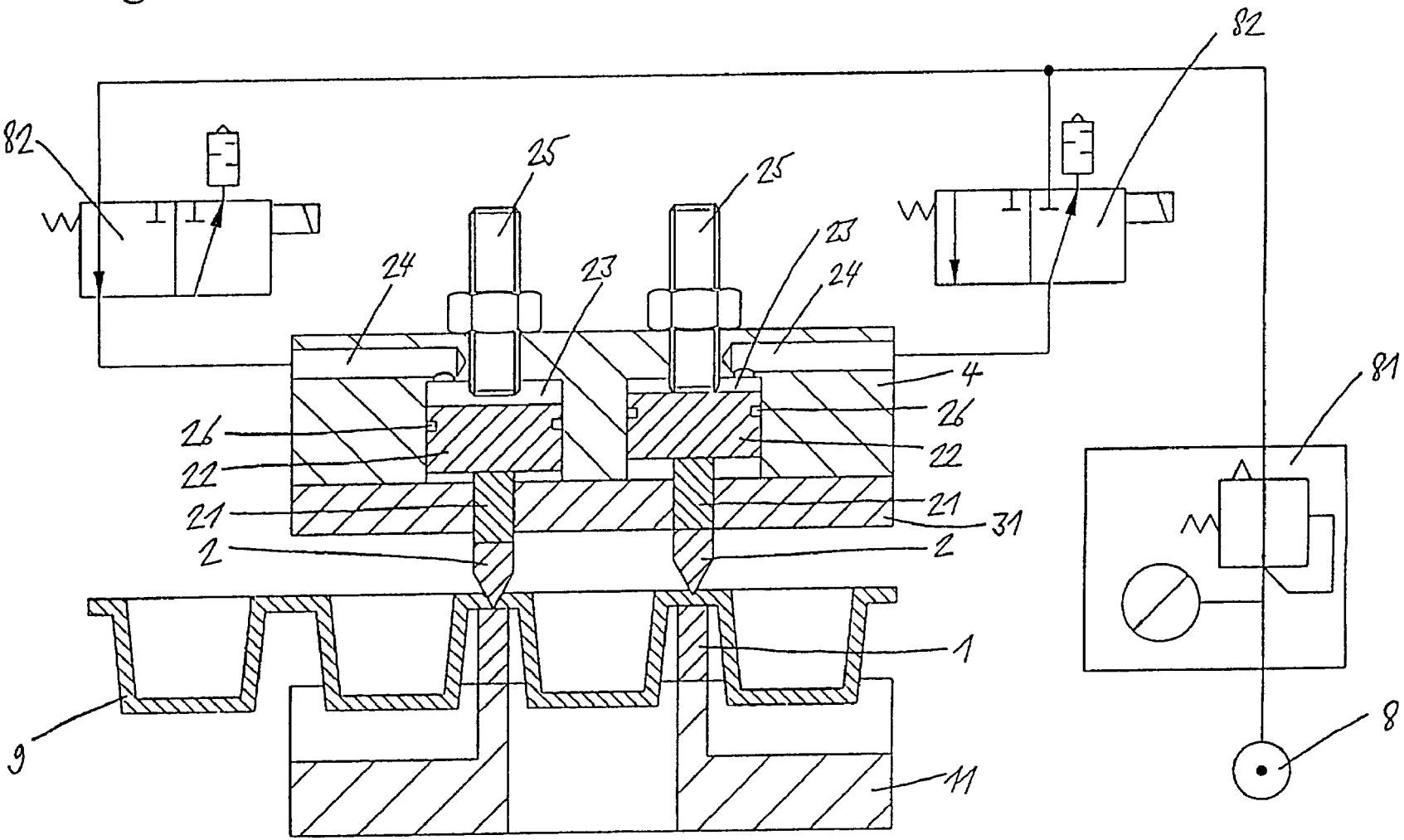
FIG. 5 shows, schematically, the chamfer cutting device according to FIG. 4 during cutting and chamfering or initial cutting of the packaging material.
Figure 6:
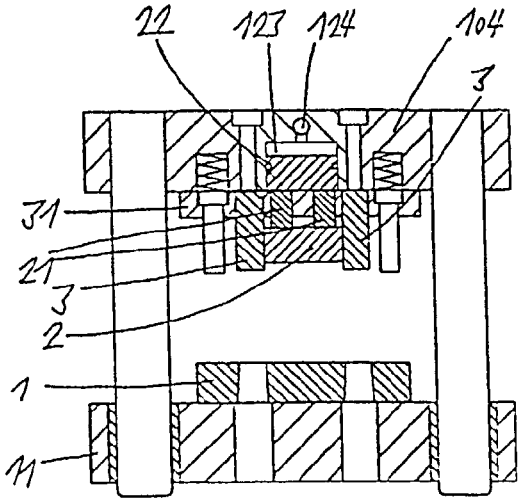
FIG. 6 shows a sectional view of part of a second exemplary embodiment of the chamfer cutting device according to the invention, having knives arranged in a force-dependent maimer by means of gas pistons.
Figure 7:
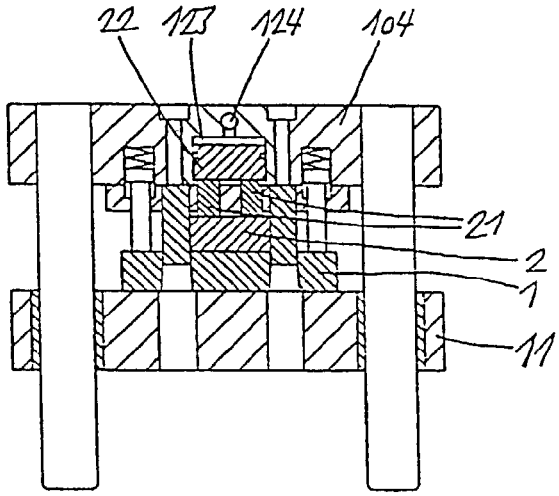
FIG. 7 shows the chamfer cutting device according to FIG. 6 in the cutting and punching position.
Figure 8:
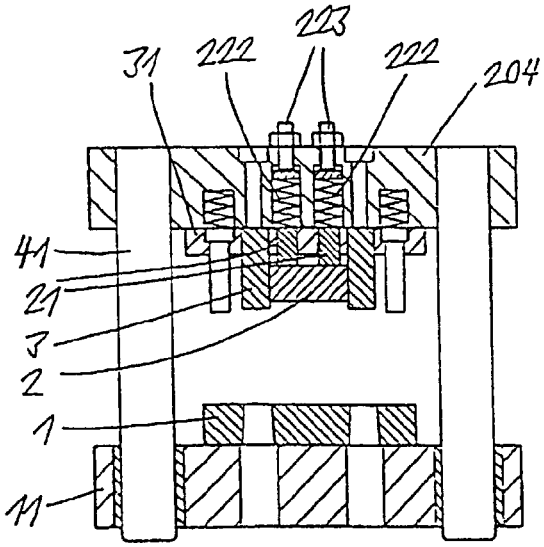
FIG. 8 shows a sectional view of part of a third exemplary embodiment of the chamfer cutting device according to the invention, having knives arranged in a force-dependent manner by means of compression springs.
Figure 9:
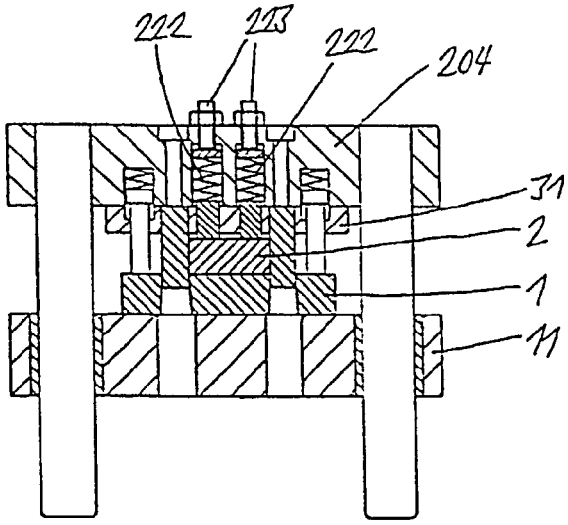
FIG. 9 shows the chamfer cutting device according to FIG. 8 in the cutting and punching position.
Figure 10:
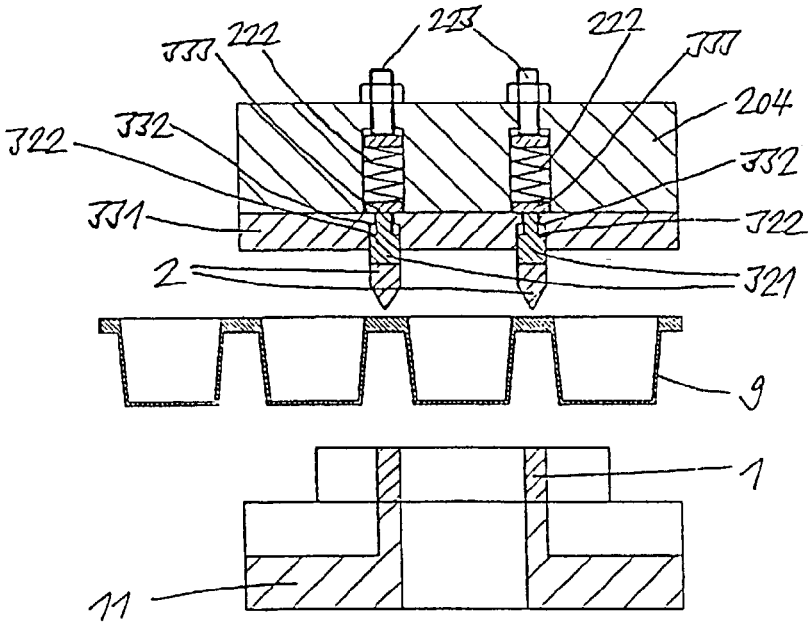
FIG. 10 shows a sectional view of part of a fourth exemplary embodiment of the chamfer cutting device according to the invention, having knives, arranged in a force-dependent manner by means of compression springs, and stops for supporting the knives.

FIG. 5 shows the chamfer cutting device when cutting packaging material 9 in the form of yogurt pots, at the time at which the die 1 and the knife part are at their smallest distance from each other. The left-hand knife 2, located in the cutting position, has cut completely through the packaging material 9 and is touching the die 1, while the right-hand knife 2, located in the chamfering position, has only begun to cut or chamfered the packaging material 9.

Figure 4:
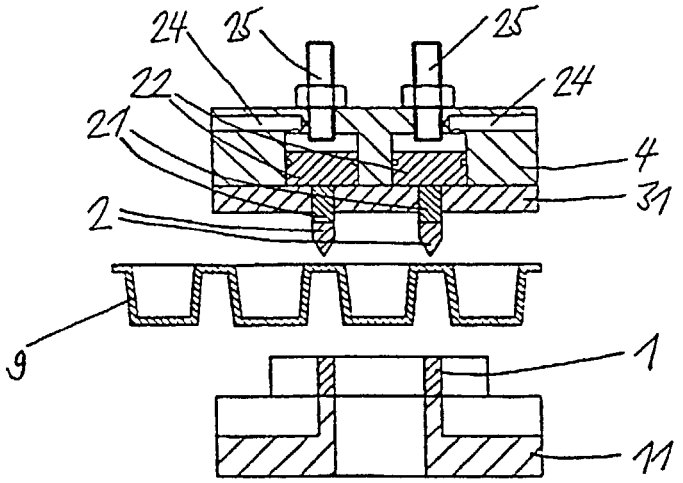
FIG. 4 shows a sectional view of part of the chamfer cutting device according to the line I—I in FIG. 1, with a packaging material stream before being cut.

The cutting position of the left-hand knife 2 results from the fact that pressurized gas is applied to the gas chamber 23 from a pressurized gas feed 8, via a pressure reducer 81, a left-hand changeover valve 82 and the left-hand gas duct 24, and exerts on the left-hand piston 22 a force which is greater than the severing force used for cutting. The necessary severing force depends on the packaging material 9 to be cut, but is normally at least 10 N per mm knife length and per mm thickness of the packaging material. It can be seen that, in the position illustrated in FIG. 5, the left-hand piston 22 has been displaced slightly upward with respect to the base position illustrated in FIG. 4, that is to say the knife 2 has been displaced upward by the die 1, compressing the pressurized gas present in the gas chamber 23.

By contrast, no pressurized gas has passed into the gas duct 24 and the gas chamber 23 via the right-hand changeover valve 82, so that the packaging material 9 has forced the right-hand knife 2 upward to such an extent that the right-hand piston 22 has struck the stop 25. The chamfer cutting depth in the packaging material 9 results from the vertical position of the stop 25, which is adjustable by means of screws.

The following definition applies to the whole of the following description. If a figure contains reference signs for the purpose of clarity of the drawing, but the signs are not explained in the immediately associated descriptive text, then reference is made to their mention in the preceding figure descriptions.

SECOND EXEMPLARY EMBODIMENT—FIGS. 6 AND 7

This second exemplary embodiment of a chamfer cutting device according to the invention largely corresponds to the first. As distinction from the first, however, on the tool plate 104 there are no adjustable stops 25 projecting into the gas chambers 123. Instead, the gas ducts 124 are in each case arranged centrally above the gas chambers 123. A chamfer cutting device designed in this way is advantageous in particular when a knife 2 sometimes has to be switched away, so that it no longer cuts at all.

THIRD EXEMPLARY EMBODIMENT—FIGS. 8 AND 9

In this third exemplary embodiment, the force-dependent arrangement of the knives 2 is not carried out by means of gas pistons but by means of two mechanical compression springs 222 in each case, which are arranged in the tool plate 204. By means of setting screws 223, an opposing or limiting force produced by the compression springs 222 can be adjusted. In the case of this spring arrangement, after reaching the opposing or limiting force, the knife 2 begins to retreat, it being necessary for the force on the knife edge to increase further as the distance by which the knife retreats increases. The opposing or limiting force can also be adjusted to the value 0. In this case, the knife 2 begins to retreat upon contact with the packaging material 9. The retreating action takes place as a function of the cutting force present on the knife 2 and, at the end of the cutting operation, decreases again until the knife 2 contacts the die 1 and the force acting on the knife 2, and therefore the retreating action, rises again. Otherwise, the construction of the chamfer cutting device corresponds to that of the first two exemplary embodiments.

FOURTH EXEMPLARY EMBODIMENT—FIGS. 10 TO 12

This fourth exemplary embodiment of a chamfer cutting device according to the invention corresponds largely to the third. As distinction therefrom, however, the punch holding plate 331 is provided with stops 332 for the knife holders 321, which have shoulders 322. In addition, an intermediate plate 333 is in each case arranged between the knife holders 321 and the compression springs 222.

Figure 11:
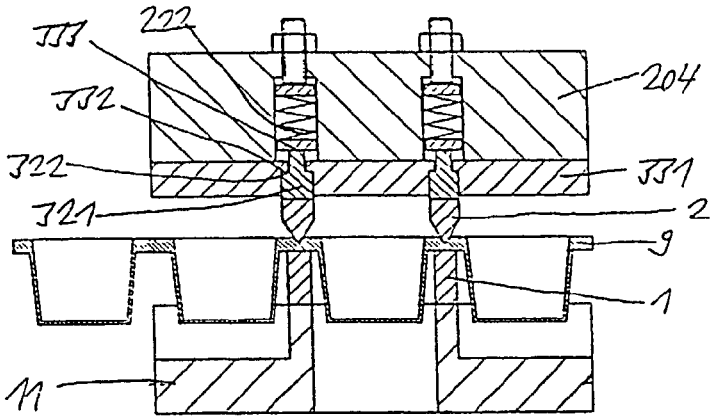
FIG. 11 shows a chamfer cutting device according to FIG. 10 in a first cutting and punching position.
Figure 12:
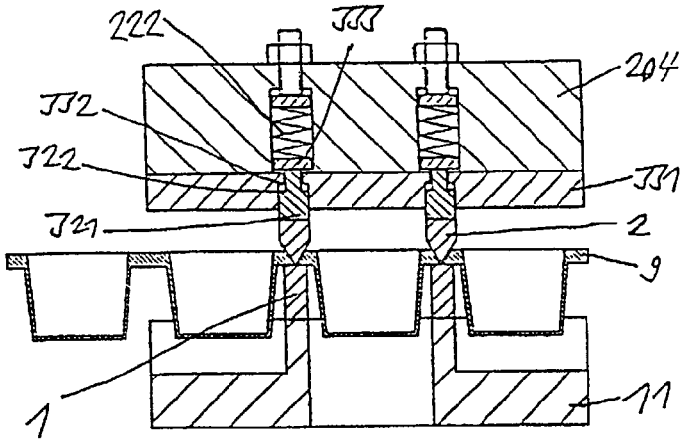
FIG. 12 shows the chamfer cutting device according to FIG. 10 in a second cutting and punching position.

As can be seen in FIG. 11, during the cutting action, the knives 2 arranged in a force-dependent manner are supported on the stops 332 via the shoulders 322 of the knife holders 321 as soon as the forces acting on the knives 2, through the compression springs 222, reach specific values, similar to the way in which this is described in the first exemplary embodiment for the knives 2 in the so-called chamfering position. If the forces acting on the knives 2 fall below the forces defined by the compression springs 222, for example toward the end of the cutting operation, the knives 2 are forced downward against the die 1 with the forces defined by the compression springs 222, as shown in FIG. 12.

Instead of being applied by the compression springs 222, the defined forces can also be applied by gas pads or by pads which are formed by a liquid medium, as in the first two exemplary embodiments.

The stops 332 additionally fulfill the function of protecting the mechanical compression springs 222 against inadmissibly high deformations or stresses, by limiting the retreat of the knives 2.

In relation to the chamfer cutting devices described above, further constructional variations can be implemented. Here, mention should expressly be made of the following:

The knife part can have a large number of knives 2 and punches 3, which can be arranged in an extremely wide range of configurations.

Figure 13:
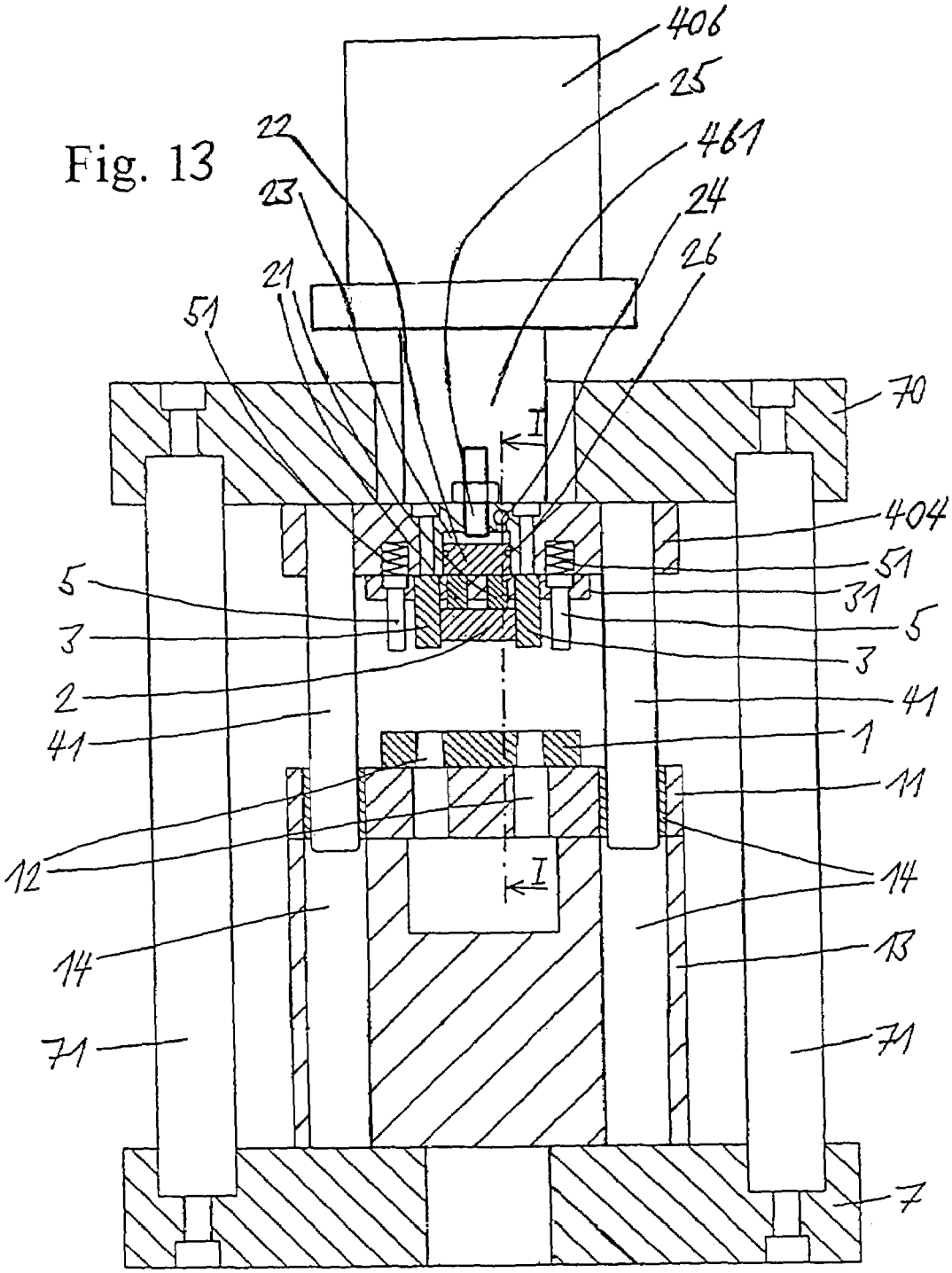
FIG. 13 shows a sectional view of a fifth exemplary embodiment of the chamfer cutting device according to the invention.

Instead of moving the die 1 toward the knife part when a cut is being carried out, conversely the knife part can be moved toward the die 1. Such an arrangement is illustrated in FIG. 13, which is similar to the first exemplary embodiment illustrated in FIG. 1. In addition to the elements of FIG. 1, the embodiment of FIG. 13 includes a hydraulic cylinder 406 and a piston 461 that is connected to tool plate 404. These elements are respectively essentially identical to the hydraulic cylinder 6, the piston 61, and the tool plate 4 of FIG. 1 except that, as just described, the knives 2 move toward the die 1 through action of the cylinder 406 and the piston 461. As the drive, in addition to the hydraulic drive shown, thought can also be given to any other desired drives with which sufficiently high forces can be produced, such as eccentric or toggle lever drives.

The invention claimed is:

1. A chamfer cutting device for cutting a packaging material, the chamfer cutting device comprising:

a die;

a tool plate;

a knife part including at least two knives, at least one of the die and the knife part being movable relative to the other to cut a packaging material interposed between the die and knife part; and a gas piston, wherein at least one knife of the knife part is mounted on the tool plate via the gas piston so that position of the at least one knife with respect to the tool plate varies as a function of force produced by contact of the at least one knife with the packaging material or the die.

2. The chamfer cutting device as claimed in claim 1, wherein the knife part is moved toward the die to cut the packaging material.

3. The chamfer cutting device as claimed in claim 1, further comprising means for feeding gas into and removing gas from a gas chamber of the gas piston, for adjusting dependence of the position of the at least one knife with respect to the tool plate on the force produced by the contact of the at least one knife with the packaging material or the die.

4. The chamfer cutting device as claimed in claim 1, wherein the at least one knife of the knife part is arranged to retreat so that, when the force produced by the contact of the at least one knife with the packaging material or the die is less than a limiting force, the at least one knife maintains position and when the force produced by the contact of the at least one knife with the packaging material or the die is greater than the limiting force, the at least one knife retreats.

5. The chamfer cutting device as claimed in claim 1, wherein the knife part is stationary and the die is moved toward the knife part, the knife part having spring-mounted strippers which, when the packaging material is cut, are tensioned by the die and the packaging material and, when the die is moved away from the knife part, strip the packaging material from the knives.

6. The chamfer cutting device as claimed in claim 1, the knife part further comprising punches which, when the packaging material is cut, punch a hole in the packaging material.

7. The chamfer cutting device as claimed in claim 1, further comprising means for adjusting a maximum force acting on the at least one knife and produced by the contact of the at least one knife with the packaging material or the die, the maximum force not being exceeded in contact between the at least one knife and the die.

8. The chamfer cutting device as claimed in claim 1, wherein the at least one knife comes into contact with the die when the packaging material is cut by moving at least one of the knife part and the die relative to the other.

9. The chamfer cutting device as claimed in claim 2, wherein each of the knives in the knife part coming into contact with the die when the packaging material is cut is mounted on the tool plate via a gas piston, individually or together with other knives in groups, such that the position of the knives in the knife part with respect to the tool plate varies as a function of the force produced by contact with the packaging material or the die.

10. The chamfer cutting device as claimed in claim 1, wherein when the packaging material is cut by moving at least one of the knife part and the die relative to the other, the force acting on the at least one knife and produced by the contact between the at least one knife and the packaging material or the die is at most 1000 N per mm of knife length and per mm of thickness of the packaging material.

11. The chamfer cuffing device as claimed in claim 10, wherein when the packaging material is cut by moving at least one of the knife part and the die relative to the other, the force acting on the at least one knife and produced by the contact between the at least one knife and the packaging material or the die is 10–100 N per mm knife length and per mm thickness of the packaging material.

12. The chamfer cutting device as claimed in claim 1, including a stop for each knife of the knife part and on which the knife is supported during a first part of a cut, in which a first cutting force is required, while, during a second part of the cut, in which a cutting force less than the first cutting force is required, the knife is spaced apart from the stop.

13. The chamfer cuffing device as claimed in claim 12, wherein the stop comprises an adjustable stop.

14. The chamfer cutting device as claimed in claim 1, wherein the arrangements of the individual knives in the knife part can be changed between a cutting position in which a knife is located between the tool plate and the die for cutting completely through the packaging material, and a chamfering position in which a knife is located between the tool plate and the die for cutting only partially through the packaging material.

15. The chamfer cutting device as claimed in claim 14, including a stop for each knife of the knife part and on which the knife is supported in the chamfering position when cutting.

16. The chamfer cuffing device as claimed in claim 15, wherein the stop comprises an adjustable stop.

* * * * *